US005473222A

United States Patent [19]

Thoeny et al.

[11] Patent Number: 5,473,222

[45] Date of Patent: Dec. 5, 1995

[54] ACTIVE MATRIX VACUUM FLUORESCENT DISPLAY WITH MICROPROCESSOR INTEGRATION

[75] Inventors: Michael B. Thoeny, Noblesville; John M. Dikeman, Kokomo; Alireza F. Borzabadi, Carmel, all of Ind.

[73] Assignee: Delco Electronics Corporation, Kokomo, Ind.

[21] Appl. No.: 270,877

[22] Filed: Jul. 5, 1994

[51] Int. Cl.[6] ..... G09G 3/10

[52] U.S. Cl. ..... 315/169.1; 315/169.3; 315/169.4

[58] Field of Search ..... 315/169.1, 169.3, 315/169.4; 313/495, 496, 505

[56] References Cited

U.S. PATENT DOCUMENTS

| | | | |
|---|---|---|---|
| 4,859,913 | 8/1989 | Genovese et al. | 315/169.4 |
| 5,099,178 | 3/1992 | Bozzer et al. | 315/169.1 |
| 5,151,632 | 9/1992 | Troxxel | 315/169 |
| 5,155,413 | 10/1992 | Bozzer et al. | 315/169.1 |
| 5,177,406 | 1/1993 | Troxell | 315/169.1 |
| 5,258,325 | 11/1993 | Spitzer et al. | 437/86 |
| 5,345,141 | 9/1994 | Moyer et al. | 313/496 X |
| 5,376,561 | 12/1994 | Vu et al. | 437/31 |
| 5,426,526 | 6/1995 | Yamamoto et al. | 359/82 |

OTHER PUBLICATIONS

"High–Resolution VFD On–a–Chip", Masahiro Yoshimura, Katsumasa Fujii, Schin'ichi Tanka, 1986 SID International Symposium, Digest of Technical Papers, First Edition, pp. 403–406.

"MOS–Addressed VFD Character Display Incorporating Static RAM," Masahiro Yoshimura, Katsumasa Fujii, and Schin'ichi Tanaka, Sashiro Uemura, Makoto Horie, 1985 SID International Symposium, Digest of Technical Papers, pp. 362–365, 1985.

*Primary Examiner*—Robert J. Pascal
*Assistant Examiner*—Haissa Philogene
*Attorney, Agent, or Firm*—Jimmy L. Funke

[57] ABSTRACT

A glass envelope contains a silicon substrate which embodies an active matrix anode array, a microprocessor, and anode driving circuits. A small number of pins on the envelope couple display parameters and control signals to the microprocessor, and logic and anode signal voltages are supplied to the substrate. The microprocessor determines which pixels in the anode array should be energized and the driving circuit addresses the array and applies energizing voltage to the selected pixels. The driving circuit is supplied by the low signal voltage and includes a voltage level shifting function to increase the level by an order of magnitude to realize a voltage high enough for adequate display brightness. The display can be made small due to the small number of pins required.

3 Claims, 2 Drawing Sheets

FIG - 3

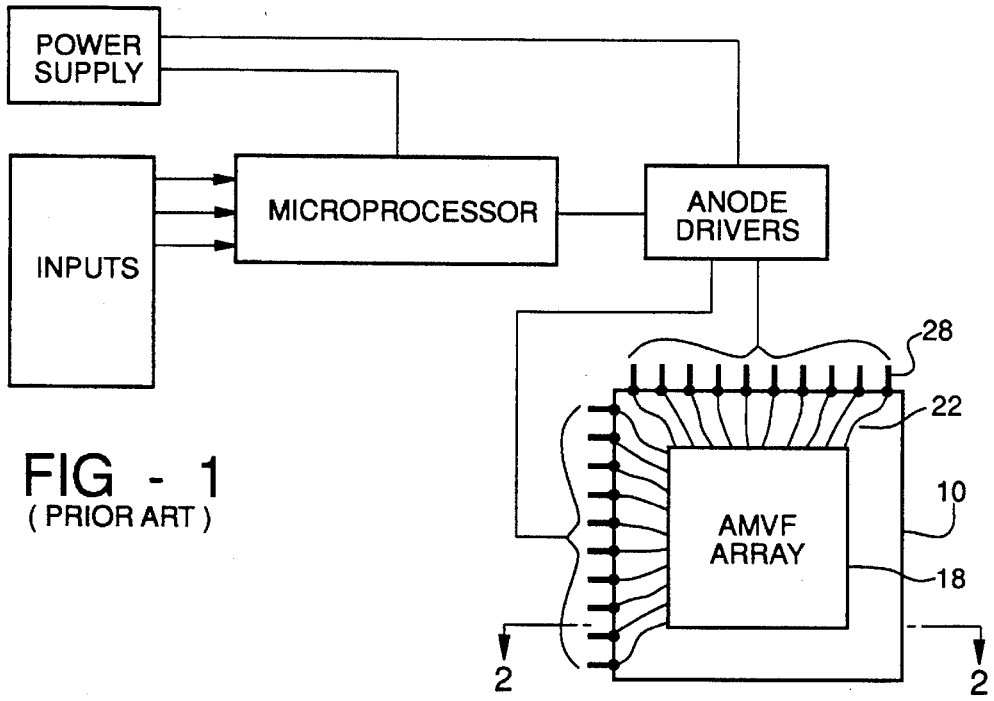
FIG - 1
( PRIOR ART )
FIG - 2
( PRIOR ART )
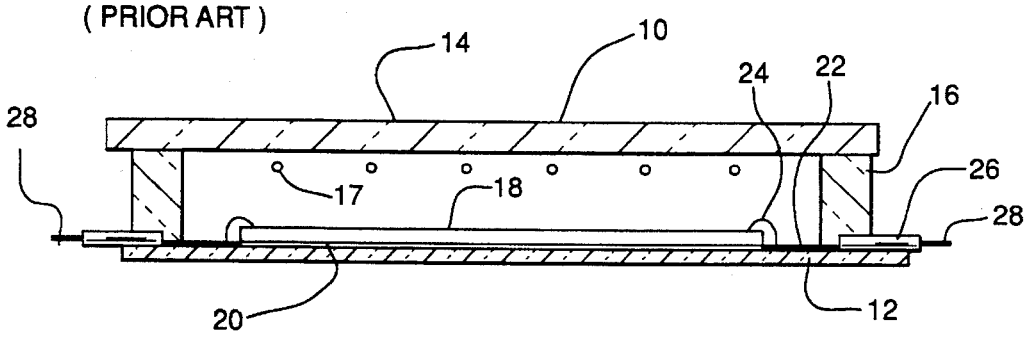
FIG - 3
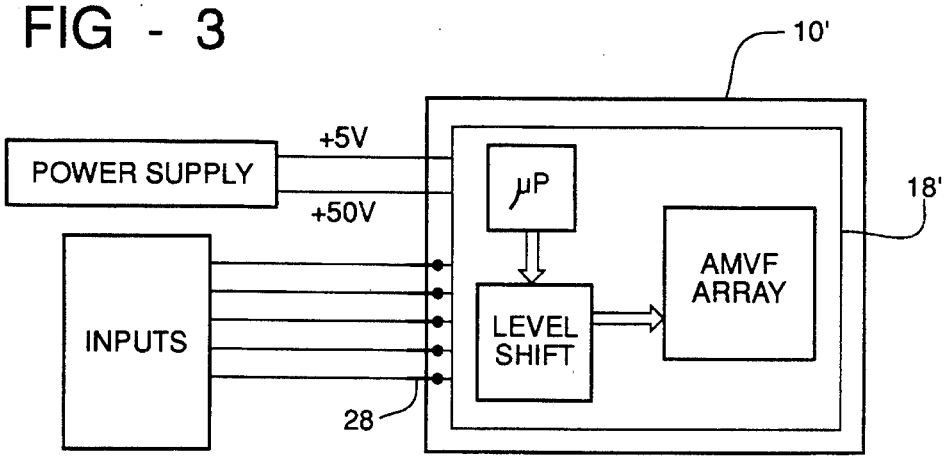

ACTIVE MATRIX VACUUM FLUORESCENT DISPLAY WITH MICROPROCESSOR INTEGRATION

FIELD OF THE INVENTION

This invention relates to vacuum fluorescent displays and particularly to such a display having a silicon substrate containing an active matrix anode array including anode drivers and a microprocessor control for the display.

BACKGROUND OF THE INVENTION

Automotive vehicles often use vacuum fluorescent displays (VFDs) as instrumentation for providing vehicle speed and other information to the operator. The display is housed in a vacuum tube having a lead frame defining pins connected to various anode portions. In external control circuitry, typically speed data, various switch states, fuel level, dimmer control, and other digital or analog information is fed to a microprocessor which determines which anode portions should be illuminated to convey the information in an orderly manner. Many outputs are then coupled from the microprocessor to the pins via drivers which supply the required voltage level for the desired illumination intensity.

Generally such VF displays use fixed segment anodes to display graphic data. Each anode segment, which comprises one of the individual graphic segments when activated, is connected via a lead frame pin of the VFD to the external control circuitry which is physically separate from the display. This control circuitry is effective to impose the correct "on" voltage on each anode segment to be illuminated and an "off" voltage on the remaining segments. Such fixed segment displays are generally dedicated to specific information, so that a large array of such displays would be required to afford all the information which might be desirably provided to the operator. In the case of direct viewing of the display, limitations in instrument panel space prohibits such expanses of display area. Moreover, when the display is used in conjunction with a head up display (HUD), very small displays are required to minimize the HUD package size. A limiting factor in size reduction is the number of lead frame pins for connection to the outside circuit device. In practice, the anode segments are multiplexed (and thus less bright) to reduce the number of VF driver outputs required and/or to reduce the number of pins to keep the package size smaller.

To show a large amount of information in a small display space it has been proposed to utilize a reconfigurable display which is capable of revealing several types of information on a time sharing basis. It is known to use conventional dot matrix displays for this purpose but these have had limited brightness due to multiplexing requirements. Heretofore such displays have driven by pinning out each row and column of the array to a lead frame for connection to external driving circuitry. Each row or column uses two pins so that, for example, a 40×64 pixel array requires more than 200 pins, thereby limiting size reduction attempts.

An improvement over the conventional dot matrix display in terms of brightness is the active matrix vacuum fluorescent display (AMVFD) which includes a silicon substrate containing pixel and display multiplexing circuitry. By sending the appropriate data to the device data lines and power supply lines, the pixels on the device are turned on or off. A variety of reconfigurable graphics such as characters, numbers, ISO symbols, map data, etc. can be displayed. The construction of such AMVFDs comprises an evacuated glass envelope having a mounting surface bearing the silicon substrate and conductive traces extending across the mounting surface from the substrate to a lead frame which affords connections to external circuitry. Wire bonds couple the conductive traces to the silicon substrate, and conductive traces extending across the mounting surface from the substrate to a lead frame which affords connections to external circuitry. Wire bonds couple the conductive traces to the silicon substrate. Filaments necessary to VFD operation are also included within the envelope. Self standing grids are not needed since a coplanar grid on the anode surface is employed. Details of such displays are disclosed in the papers "MOS-Addressed VFD Character Display Incorporating Static RAM", Uemura et al, SID 85 Digest, 362 and "High-Resolution VFD On-a-Chip", Yoshimura et al, SID 86 Digest, 403, which are incorporated herein by reference. Disadvantages of the AMVFD are the high cost of the silicon substrate and the need for individual pins for each row and column, as in the conventional dot matrix display. It is desirable, however to obtain the advantages of the AMVFD in a smaller size and at a lower cost.

SUMMARY OF THE INVENTION

It is therefore an object of the invention to take advantage of the brightness and reconfiguration properties of the active matrix VFD while minimizing the cost of the resulting display. Another object is to reduce the number of pins required for connection to external circuitry, thus allowing the display size to be reduced.

The invention is carried out by employing a silicon substrate mounted in the glass envelope of the display, the substrate containing an AMVFD, a microprocessor for controlling the AMVFD, drivers and level shifting circuitry for supplying the correct voltage to each pixel of the display, and interface circuits. Only minimal external circuitry is needed to supply power, vehicle parameters and control data to the interface circuits and thus relatively few connection pins are required to handle the inputs. A lead frame contains the connecting pins at the envelope periphery, and aluminum traces on the glass extend from the pins to the edge of the silicon substrate and are wire bonded to pads on the substrate. Row and column drivers for the anode array are embodied on the same substrate and thus connected to the array through numerous conductive paths in the substrate. The resulting small number of pins in the lead frame permits the display to be made small. Economies due to small display size and the reduction of external circuitry help to make the display practical. The drivers include level shifting so that a low signal level voltage can be increased to a high voltage for anode energization necessary for high display intensity.

BRIEF DESCRIPTION OF THE DRAWING

The above and other advantages of the invention will become more apparent from the following description taken in conjunction with the accompanying drawings wherein like references refer to like parts and wherein:

FIG. 1 is a schematic diagram of a prior art active matrix vacuum fluorescent display with external control circuitry;

FIG. 2 is a cross section along line 2—2 of the display of FIG. 1;

FIG. 3 is a schematic diagram of an active matrix vacuum fluorescent display with internal control circuitry coupled to external inputs according to the invention.

DESCRIPTION OF THE INVENTION

Figure 4:
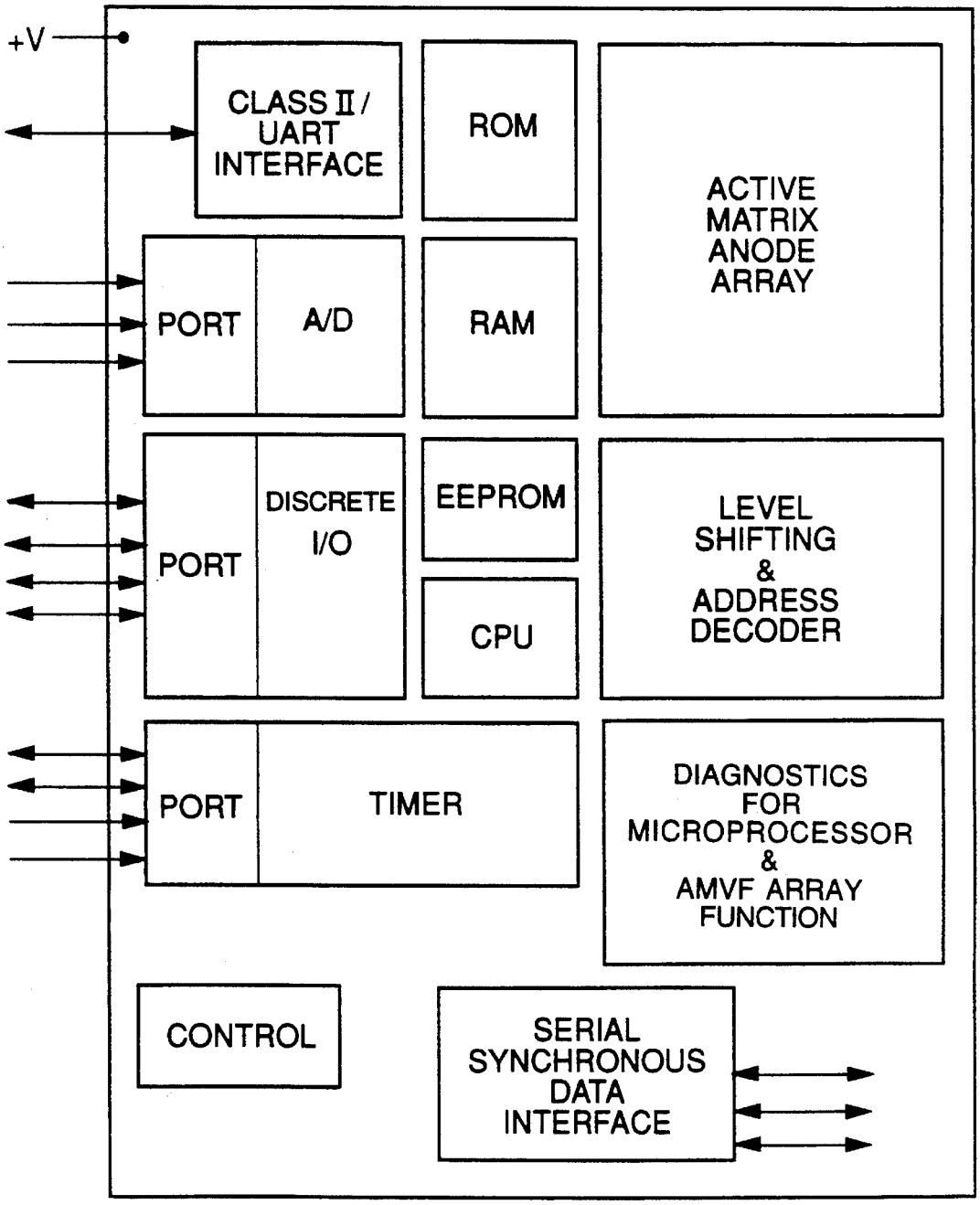
FIG. 4 is a detailed block diagram of the contents of a silicon substrate of the display of FIG. 3.

Prior AMVFD technology is discussed first to provide a reference for comparison with the improvement according to the invention. FIG. 1 depicts a system using an AMVF array controlled by external circuitry comprising a microprocessor which receives inputs representing vehicle parameters and control signals and decodes the signals to determine which pixels of the array should be illuminated to present the information. Drivers responsive to the control signals apply energizing voltages to the AMVF array via a large number of pins in the display lead frame. The drivers must deliver high voltages to achieve sufficient display brightness. A power supply affords the necessary voltages to the microprocessor and to the drivers. Diagnostic circuitry verifies that the driver outputs are consistent with the pixel energization selected by the microprocessor.

The construction of such an AMVFD, as shown in FIG. 2, comprises an evacuated glass envelope 10 having a lower glass substrate 12, an upper glass cover 14, and glass frit sealer 16 forming side walls. Filaments 17 are suspended near the top glass. The bottom glass 12 defines a mounting surface bearing a silicon substrate 18 secured to the glass by epoxy adhesive 20. Conductive traces 22 on the glass mounting surface are connected to pads on the silicon substrate 18 by wire bonds 24. The traces 22 extend to a lead frame 26 and are connected to pins 28. The lead frame extends through the sealer 16 and the pins thus protrude outwardly from the envelope for connection to the external circuit. Since the large number of columns and rows of the display require many pins 28, the envelope must be large enough to accommodate them.

FIG. 3 provides an overview of the improved AMVFD according to the preferred embodiment of the invention. There the envelope 10' has essentially the same structure as that described above except that it has relatively few pins. The silicon substrate 18' contains not only the AMVF array, but also the microprocessor and the driver or level shifting and address decoder circuit. The inputs and external control signals are few in number and are connected directly to the substrate 18' via the pins 28. Thus the pin count is low and the envelope can be made small. All the numerous connections from the driver to the rows and columns of the array are carried out by conductors integrated in the silicon substrate. A power supply delivers logic level voltage, about 5 volts, as well as pixel drive (or anode) voltage, say, about 50 volts, to the substrate.

The combined microprocessor, level shifter and AMVF array on the silicon substrate are shown in more detail in FIG. 4. Preferably the microprocessor includes a CPU, a variety of memory units comprising RAM, ROM and EEPROM, a control for handling resets and interrupt requests, and interface elements including a class II or UART serial interface, A/D ports, I/O ports, and a timer. The memory components are configured according to the specific application. The majority of the product software can be mask programmed into microprocessor ROM, with individual product variations being stored in the EEPROM. The class II serial bus interface is compatible with a vehicle communication bus and it allows the microprocessor to communicate with the external circuitry to determine the proper graphics to display. If desired a high speed serial synchronous data interface can be used with or instead of the slower Class II or UART interface. The serial interface, for example, would be useful to rapidly receive map data for display of a map for navigational purposes.

The A/D ports receive vehicle system voltage and other analog values such as fuel level, temperature, and a control signal from a dimmer potentiometer. The I/O ports receive discrete inputs from the vehicle which denote various switch states such as turn signal, brake warning, high beam or other telltale signals. The timer receives a pulsed speedometer signal and determines speed from the pulse period, and also provides a number of timing signals used internally. The control component receives interrupt requests and a reset signal. While the number of input pins required on the envelope depends of the specific application, generally about 30 pins is sufficient to supply the display, compared to over 200 pins used by the prior art configuration for a 40 by 64 pixel display. A larger display would require the same small number of pins. This drastic reduction of pin count allows the display package to be much smaller.

The level shift and address decoder is under control of the microprocessor and comprises the interface between the microprocessor and the AMVF array. It addresses the pixels to be illuminated and applies sufficient voltage to the selected anodes to illuminate them. The addressing of the AMVF array is essentially the same as addressing a static RAM and is done by multiplexing. The required high voltage is on the order of 50 volts or more and thus the voltage level must be increased by about an order of magnitude.

Diagnostic circuitry is also included on the substrate to check the microprocessor operation and to verify that the energized pixels are indeed those which are selected by the microprocessor to be illuminated.

It will thus be seen that by reason of integrating the anode array and the control circuitry on the same substrate that a much smaller display size is possible and the external support circuitry is drastically reduced, thereby improving both the cost of such a display but its utility as well.

The embodiments of the invention in which an exclusive property or privilege is claimed are defined as follows:

1. An integrated vacuum fluorescent display comprising:

a vacuum fluorescent display tube having cathode elements;

a support surface of the display tube having a silicon substrate spaced from the cathode elements, the substrate containing an active matrix anode array, a microprocessor, and an interface coupling the microprocessor to the array;

the interface including anode drivers for controlling pixel activation in response to signals from the microprocessor; and the silicon substrate further containing conductive paths for connecting the interface to the microprocessor and to the anode array.

2. The invention as defined in claim 1 wherein terminals at an edge of the support surface are connected to the microprocessor and wherein logic level and anode voltage, control data and display parameters are fed to the microprocessor via said terminals.

3. The invention as defined in claim 2 wherein the interface includes level shifting circuitry supplied by the logic level and anode voltage for converting low voltage data to high voltage data, which is an order of magnitude greater than the logic level voltages used for microprocessor operation.

* * * * *